United States Patent [19]

Tsukamoto

[11] Patent Number: 4,974,978

[45] Date of Patent: Dec. 4, 1990

[54] TYPEWRITER HAVING A CARRIAGE WHICH IS SHIFTED WHEN NO CHARACTER DATA IS STORED IN A MEMORY, SPACE DATA HAS BEEN INPUT, AND THE TYPEWRITER OPERATES IN A MODE IN WHICH A PLURALITY OF INPUT CHARACTER DATA IS STORED AND THEN PRINTED AT ONE TIME

[75] Inventor: Takahiro Tsukamoto, Mitaka, Japan

[73] Assignee: Canon Kabushiki Kaisha, Tokyo, Japan

[21] Appl. No.: 171,149

[22] Filed: Mar. 21, 1988

Related U.S. Application Data

[63] Continuation of Ser. No. 24,926, Mar. 12, 1987, abandoned, which is a continuation of Ser. No. 698,596, Feb. 6, 1985, abandoned.

[30] Foreign Application Priority Data

Feb. 14, 1984 [JP] Japan ..... 59-24446

[51] Int. Cl.[5] ..... B41J 19/18

[52] U.S. Cl. ..... 400/320; 400/76; 400/279

[58] Field of Search ..... 400/8, 61, 63, 70, 76, 400/83, 284, 320, 342, 705.1

[56] References Cited

U.S. PATENT DOCUMENTS

| | | | |
|---|---|---|---|
| 2,093,545 | 9/1937 | Bryce et al. | 400/705.1 X |
| 4,223,339 | 9/1980 | Abe et al. | 400/83 X |
| 4,223,393 | 9/1980 | Abe et al. | 400/83 X |
| 4,311,399 | 1/1982 | Wegryn et al. | 400/342 X |
| 4,403,301 | 9/1983 | Fessel | 400/63 X |
| 4,497,589 | 2/1985 | Figini et al. | 400/61 |

FOREIGN PATENT DOCUMENTS

| | | | |
|---|---|---|---|
| 3019704 | 12/1981 | Fed. Rep. of Germany . | |
| 2055493 | 5/1981 | United Kingdom | 400/83 |
| 2087115 | 5/1982 | United Kingdom | 400/83 |

*Primary Examiner*—David A. Wiecking

*Attorney, Agent, or Firm*—Fitzpatrick, Cella, Harper & Scinto

[57] ABSTRACT

A print apparatus is provided to perform in a Character-By-Character mode, a print operation or a function processing operation depending upon whether or not the pressed key is a character key. On the other hand, in a Line-By-Line mode, when the pressed key is not a carriage shift key, a character storing operation or a function processing operation including a print operation is performed depending upon whether or not the pressed key is a character key. In the Line-By-Line mode, when no character is keyed in, a carriage shift operation is performed, thereby allowing the positions of tabs/margins and the position at which print starts to be changed.

10 Claims, 4 Drawing Sheets

TYPEWRITER HAVING A CARRIAGE WHICH IS SHIFTED WHEN NO CHARACTER DATA IS STORED IN A MEMORY, SPACE DATA HAS BEEN INPUT, AND THE TYPEWRITER OPERATES IN A MODE IN WHICH A PLURALITY OF INPUT CHARACTER DATA IS STORED AND THEN PRINTED AT ONE TIME

This application is a continuation of application Ser. No. 024,926 filed Mar. 12, 1987, now abandoned, which was a continuation of application Ser. No. 698,596 filed Feb. 6, 1985, now abandoned.

BACKGROUND OF THE INVENTION

1. Field of the Invention

The present invention relates to a print apparatus which is able to change the position of a carriage irrespective of a set operating mode.

2. Description of the Prior Art

Recent print apparatuses operate in several operating modes; a CHARACTER-BY-CHARACTER mode (hereinafter referred to as C/C mode) and a LINE-BY-LINE mode (hereinafter referred to as L/L mode). The C/C mode is the operating mode in which every time a single character is keyed in, the character is printed out, as can be seen in a conventional typewriter. On the other hand, the L/L mode is the operating mode in which a plurality of characters are keyed in and when a predetermined print key is then pressed, the plurality of characters are printed out successively.

Print apparatuses are known to include a control circuit such as a microcomputer, a memory such as a RAM, and an operation circuit. They can freely set the positions of right and left margins and of a plurality of tabs.

In the print apparatus described above, if the operator wants to change the positions of tabs or margins or the position at which print starts when the L/L mode has been selected, he must perform special operations; namely, changing the L/L mode to the C/C mode, operating the keyboard to shift the carriage, thereby fulfilling a desired function, and then resetting the C/C mode to the L/L mode. Such a complicated operation of keys may cause error. Simplification of the operation is desired.

SUMMARY OF THE INVENTION

It is, in consideration of the above drawback, an object of the present invention to provide a print apparatus which, even when the L/L mode is set, can shift the carriage without changing the mode to the C/C mode, thereby facilitating the change of positions of tabs and margins and the position at which print starts.

In order to attain this object, according to the present invention, a print apparatus capable of setting an operating mode in which a plurality of characters are keyed in and then a particular key is pressed to thereby print the plurality of characters, includes control means which shifts the carriage in response to a carriage shift key pressed after the operating mode has been set.

It is another object of the present invention to provide a print apparatus which determines whether or not characters are inputted by input means and whether or not the carriage should be shifted in accordance with the result of the first determination.

It is still another object of the present invention to provide a print apparatus which can shift the carriage even when the L/L mode is selected.

DETAILED DESCRIPTION OF THE PREFERRED EMBODIMENT

Now, the present invention will be described in more detail with respect to the accompanying drawings.

Figure 1:
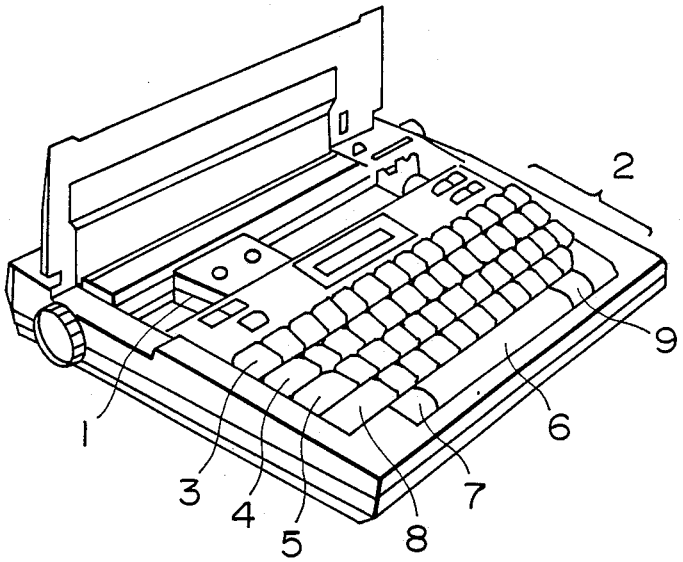
FIG. 1 is a perspective view of a print apparatus in which the present invention is embodied.
Figure 2:
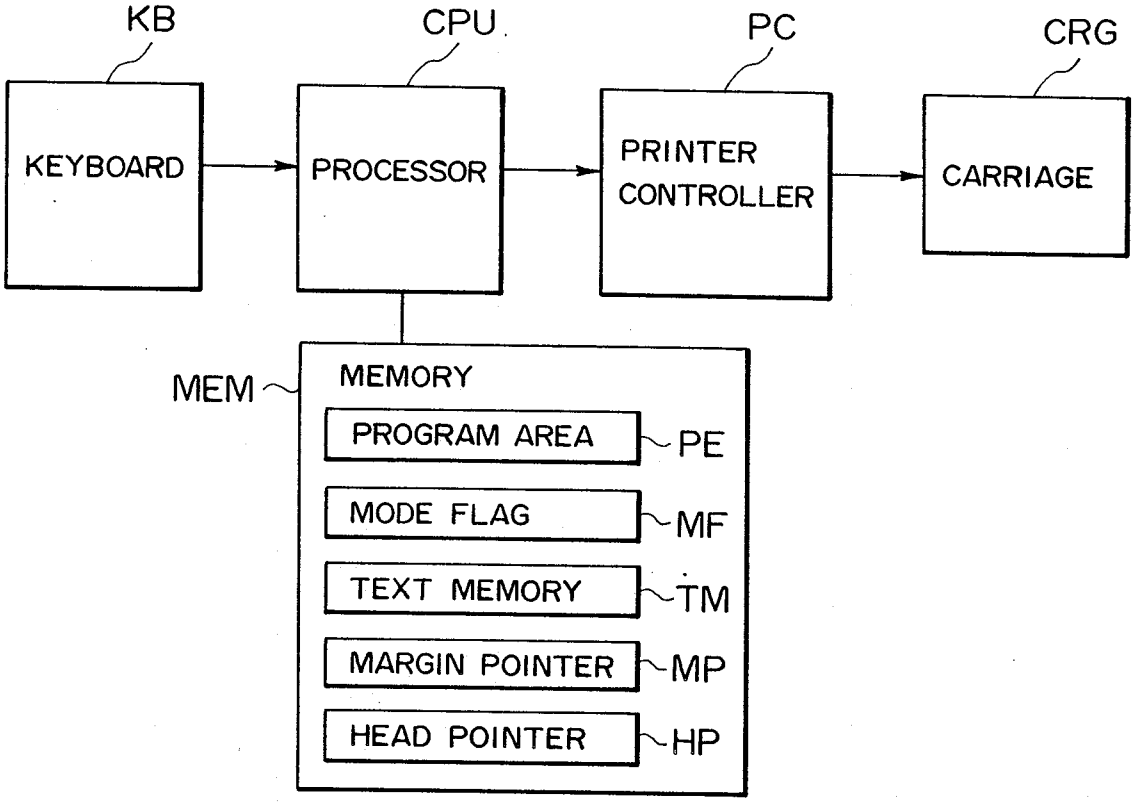
FIG. 2 is a block diagram of an electrical structure included in the print apparatus of FIG. 1.

FIG. 1 is a perspective view of an example of a print apparatus in which the present invention is embodied. FIG. 2 is a block diagram of an electrical structure included in the print apparatus of FIG. 1.

Referring to FIG. 1, reference numeral 1 denotes a carriage on which print means, e.g., a thermal head or wire head, are mounted. Reference numeral 2 denotes a keyboard as input means. The keyboard 2 includes carriage shift keys which are a C/C mode specifying key 3, an L/L mode specifying key 4, a print start key 5 actuated in the L/L mode, a space key 6 which serves to form a space between a character and an adjacent character, and a back space key 7; and function keys which are a margin setting key 8 and a tab setting key 9.

In FIG. 2, reference character KB denotes the keyboard. Reference character CPU denotes a processor which carries out arithmetic operations, logic determinations, etc. Reference character MEM denotes a memory which includes a program area PE for storing a control program shown by the flowchart of FIG. 3, a mode flag MF which is set to 0 in the C/C mode and 1 in the L/L mode, and a text memory TM which stores key codes inputted from the keyboard KB. Reference character MP denotes a margin pointer which stores data representative of the set positions of the margin. Reference character HP denotes a head pointer which stores data representative of the position of the carriage. Reference character PC denotes a print controller and CRG denotes the carriage.

Now assume that the operating mode of the print apparatus has been changed from the C/C mode to the L/L mode by pressing of the L/L mode specifying key and that no characters are yet pressed; namely the mode flag MF is set to 1 and the text memory TM has not yet stored any key code because no character keys have been pressed yet. When they are pressed, key codes are generated, which are stored in the text memory TM. In addition, assume that the carriage is located at the left margin. At this time, the space key 6 should be pressed one time in order to set the left margin to the position rightwardly shifted by one space from the current position. For this reason, the carriage 1 of FIG. 1 is shifted rightward by one space hereinafter. The left margin setting key 8 on the keyboard is then pressed.

These operations set the left margin at the present position of the carriage, so that when a plurality of characters are keyed in and the print start key is then pressed, the plurality of characters are printed out.

Figures 3, 3A:
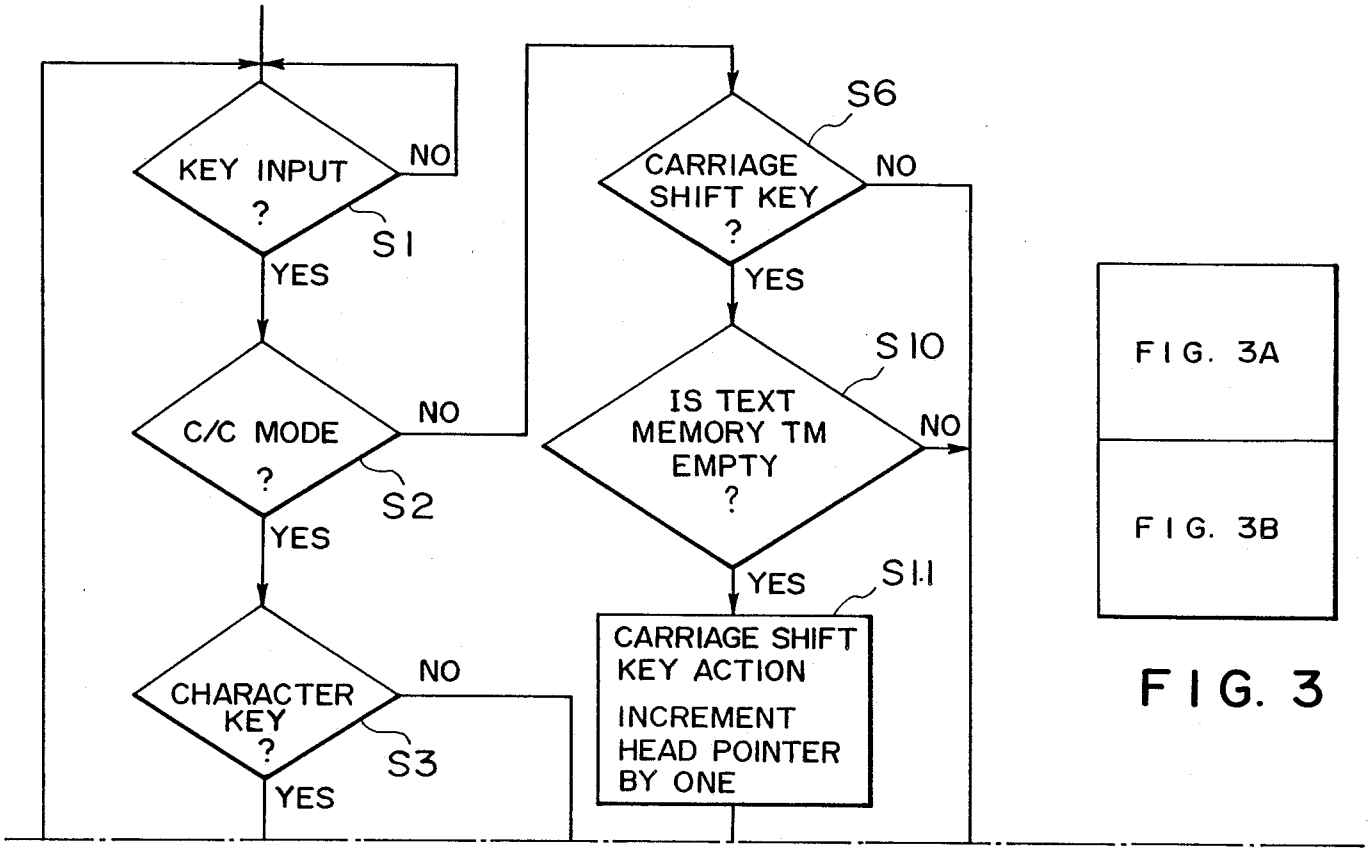
FIGS. 3, 3A and 3B are a flowchart of a program for controlling the operation of the structure of FIG. 2.
Figure 3B:
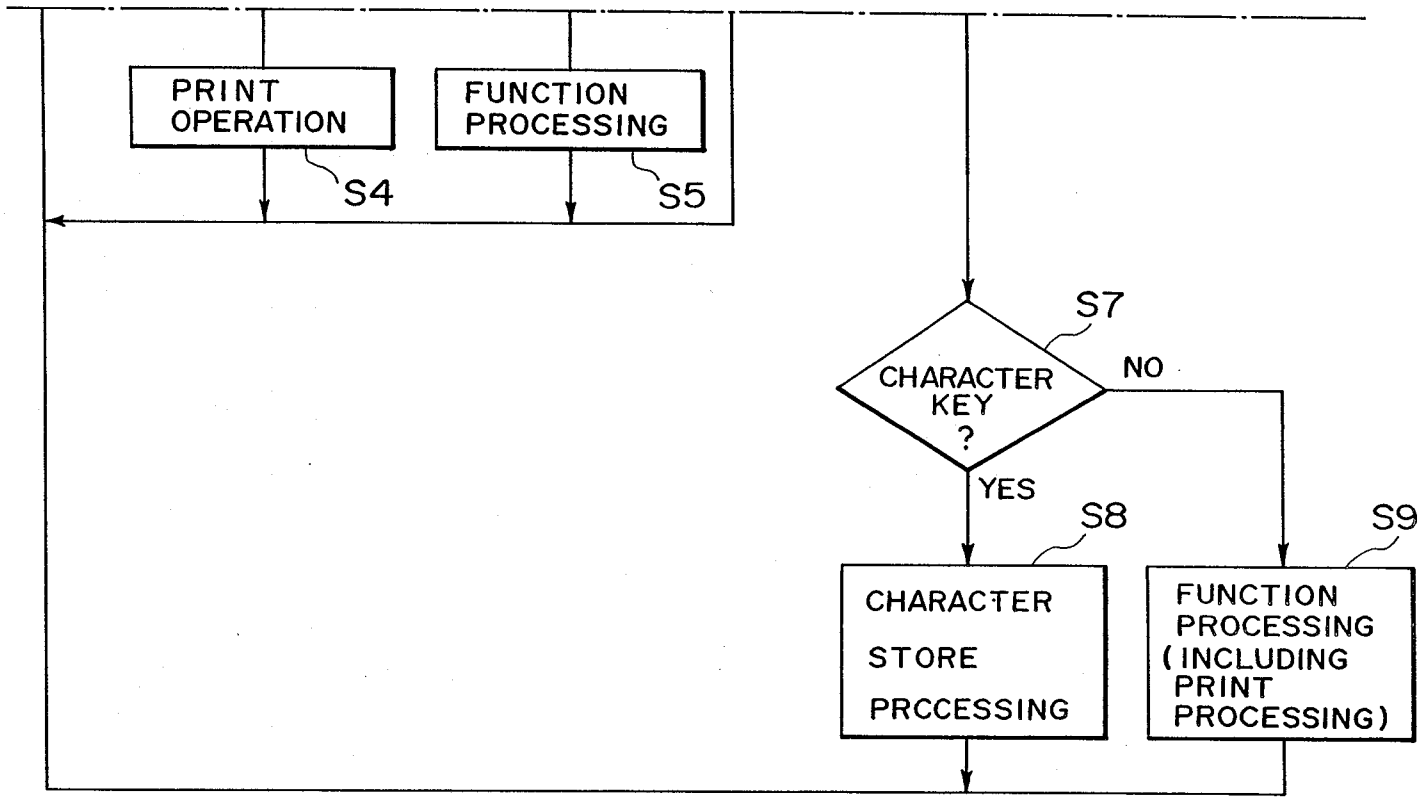

The above operations will be further described with respect to the flowchart of FIG. 3.

First, at a step S1, pressing of any key is awaited.

When any key is pressed, the operating mode of the apparatus is checked with reference to the mode flag MF at a step S2.

When the operating mode of the apparatus is set to the C/C mode, it is determined at a step S3 whether or not the pressed key is a character key. When it is determined to be a character key, print operation at a step S4 is carried out. Control flow then returns to the key input awaiting routine (step S1).

When the pressed key is determined to be a function key and not a character key at the step S3, the corresponding functions (except for print operation) are performed at a step S5. Control flow also returns to the key input awaiting routine (step S1).

When the operating mode is determined to be the L/L mode at the step S2, it is determined at a step S6 whether or not the pressed key is a carriage shift key.

When it is determined not to be a carriage shift key at the step S6, control flow is forwarded to a character key determining routine at a step S7.

When the pressed key is determined to be a character key at the step S7, a character is stored in the text memory TM in the L/L mode at a step S8.

When the pressed key is determined to be a function key at the step S7, corresponding function processing (including print operation) is performed at a step S9. For example, in the case of margin setting, the values of the head pointer HP are stored in the margin pointer MP.

After execution of the step S8 or S9, control flow returns to the key input awaiting routine (step S1).

At the step S6, when the pressed key is determined to be a carriage shift key, control flow passes to a step S10.

At the step S10, the processor CPU determines by reference to, e.g., the text memory TM whether or not any character key is keyed in after the operation mode of the apparatus has been set to the L/L mode, or whether or not any character key is keyed in after the print start key has been pressed. When it is determined that no character is keyed in, namely, when the text memory TM is empty, the carriage is shifted and the head pointer HP is incremented by one at a step S11. Then, control flow returns to the key input awaiting routine (step S1). On the other hand, when any character key is pressed, control flow passes to the step S7.

As described above, according to the present invention, even when the print apparatus is set to the L/L mode, the carriage can be shifted if no character key is pressed, so that the positions of tabs/margins and the position at which print starts can be changed by a simple operation.

I claim:

1. A typewriter comprising:

input means for inputting character data, the character data including space data;

print means for printing the character data input by said input means, said print means including a carriage;

mode changeover means for performing a mode changeover between a first print mode and a second print mode, in said first print mode each character data being printed each time such character data is input by said input means, and in said second print mode the plurality of character data input by said input means being stored and then printed at one time;

storage means for storing the character data input by said input means in a state that said second print mode is set by said mode changeover means;

discrimination means for determining whether or not there is any character data stored in said storage means; and control means, responsive to the space data from said input means, for, in said second print mode, shifting said carriage when it is determined that no character data is stored in said storage means, and for storing the space data into said storage means when it is determined by said discrimination means that the character data is stored in said storage means.

2. A typewriter according claim 1, wherein said input means includes a space key.

3. A typewriter according to claim 1, wherein said mode changeover means includes mode storage means for storing data indicative said first or second print mode.

4. A typewriter according to claim 1, further comprising a pointer for indicating the position of said carriage.

5. A typewriter according to claim 1, further comprising a margin pointer which stores as a margin position the moved position of said carriage effected by said control means.

6. A typewriter comprising:

input means for inputting character data, the character data including space data;

mode changeover means for performing a mode changeover between a first print mode and a second print mode, in said first print mode each character data being printed each time such character data is input by said input means, and in said second print mode the plurality of character data input by said input means being stored and then printed at one time;

storage means for storing the character data input by said input means in a state that said second print mode is set by said mode changeover means;

discrimination means for determining whether or not the space data from said input means is the first input of character data after said mode changeover means is set to said second mode; and control means for, in said second print mode, shifting a carriage while temporarily disabling said storage means so that space data is not stored when it is determined by said discrimination means that the space data input by said input means is the first input of character data after said mode changeover means is set to said second mode, and for storing the space data into said storage means when it is determined that the space data is not the first input of character data after said mode changeover means is set to said second mode.

7. A typewriter according to claim 6, wherein said input means includes a space key.

8. A typewriter according to claim 6, wherein said mode changeover means includes mode storage data indicative of means for storing said first or second print mode.

9. A typewriter according to claim 6, further comprising a pointer for indicating the position of said carriage.

10. A typewriter according to claim 6, further comprising a margin pointer which stores as a margin position the moved position of said carriage effected by said control means.

* * * * *

UNITED STATES PATENT AND TRADEMARK OFFICE

CERTIFICATE OF CORRECTION

PATENT NO. : 4,974,978

DATED : December 4, 1990

INVENTOR(S) : Takahiro TSUKAMOTO

It is certified that error appears in the above-identified patent and that said Letters Patent is hereby corrected as shown below:

Title page:

[56] At References Cited

U.S. PATENT DOCUMENTS:

"4,223,339 9/1980 Abe et al..... 400/83X"
should be deleted.

COLUMN 4:

Line 17, "indicative said" should read
--indicative of said--;

Line 58, "data" should be deleted; and

Line 59, "indicative of means for storing"
should read --means for storing data
indicative of--.

Signed and Sealed this

Fourth Day of August, 1992

*Attest:*

DOUGLAS B. COMER

*Attesting Officer*

*Acting Commissioner of Patents and Trademarks*